US010096418B2

(12) United States Patent
Arai et al.

(10) Patent No.: US 10,096,418 B2
(45) **Date of Patent: *Oct. 9, 2018**

(54) LAMINATED INDUCTOR

(71) Applicant: Taiyo Yuden Co., Ltd., Tokyo (JP)

(72) Inventors: Takayuki Arai, Tokyo (JP); Ryuichi Kondou, Tokyo (JP); Akiko Yamaguchi, Tokyo (JP); Shinsuke Takeoka, Tokyo (JP); Kazuhiko Oyama, Tokyo (JP); Kenji Otake, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/849,966

(22) Filed: Dec. 21, 2017

(65) Prior Publication Data

US 2018/0114627 A1 Apr. 26, 2018

Related U.S. Application Data

(63) Continuation of application No. 15/275,924, filed on Sep. 26, 2016, now Pat. No. 9,892,843.

(30) Foreign Application Priority Data

Nov. 17, 2015 (JP) ..... 2015-225178

(51) Int. Cl.
*H01F 5/00* (2006.01)
*H01F 27/245* (2006.01)
(Continued)

(52) U.S. Cl.
CPC ..... *H01F 27/245* (2013.01); *H01F 1/0306* (2013.01); *H01F 1/28* (2013.01);
(Continued)

(58) Field of Classification Search
CPC ..... H01F 5/00; H01F 27/00–27/36
(Continued)

(56) References Cited

U.S. PATENT DOCUMENTS 6,054,914 A 4/2000 Abel
2001/0017582 A1 8/2001 Sakata
(Continued)

FOREIGN PATENT DOCUMENTS

JP 2016-062424 3/2010

OTHER PUBLICATIONS

Notice of Allowance U.S. Appl. No. 15/275,924 dated Sep. 26, 2017.

*Primary Examiner* — Tuyen Nguyen
(74) *Attorney, Agent, or Firm* — Pillsbury Winthrop Shaw Pittman, LLP

(57) ABSTRACT

One object is to provide a laminated inductor having a reduced thickness without reduction in the magnetic characteristic and the insulation quality. The laminated inductor includes a first magnetic layer, an internal conductor, second magnetic layers, third magnetic layers, and a pair of external electrodes. The first magnetic layer includes three or more magnetic alloy particles arranged in the thickness direction and an oxide film binding the magnetic alloy particles together and containing Cr. The three or more magnetic alloy particles have an average particle diameter of 4 μm or smaller. The internal conductor includes a plurality of conductive patterned portions electrically connected to each other via the first magnetic layer. The second magnetic layers are composed of magnetic alloy particles and disposed around the conductive patterned portions. The third magnetic layers are composed of magnetic alloy particles and disposed so as to be opposed to each other in thickness direction.

6 Claims, 6 Drawing Sheets

(51) Int. Cl.

| | |
|---|---|
| ***H01F 27/29*** | (2006.01) |
| ***H01F 17/04*** | (2006.01) |
| ***H01F 1/03*** | (2006.01) |
| ***H01F 27/28*** | (2006.01) |
| ***H01F 17/00*** | (2006.01) |
| ***H01F 27/255*** | (2006.01) |
| ***H01F 1/28*** | (2006.01) |

(52) U.S. Cl.
CPC ..... *H01F 5/00* (2013.01); *H01F 17/0013* (2013.01); *H01F 17/04* (2013.01); *H01F 27/255* (2013.01); *H01F 27/2804* (2013.01); *H01F 27/29* (2013.01); *H01F 27/292* (2013.01)

(58) Field of Classification Search
USPC ..... 336/65, 83, 200, 232
See application file for complete search history.

(56) References Cited

U.S. PATENT DOCUMENTS

| | | | |
|---|---|---|---|
| 2013/0033347 | A1 | 2/2013 | Matsuura |
| 2013/0127576 | A1 | 5/2013 | Hachiya |
| 2013/0176096 | A1 | 7/2013 | Takahashi |

LAMINATED INDUCTOR

CROSS-REFERENCE TO RELATED APPLICATIONS

This application is a Continuation application of U.S. Ser. No. 15/275,924, filed Sep. 26, 2017 which is based on and claims the benefit of priority from Japanese Patent Application Serial No. 2015-225178 (filed on Nov. 17, 2015), the contents of each of which are hereby incorporated by reference in their entirety.

TECHNICAL FIELD

The present invention relates to a laminated inductor including a magnetic portion made of magnetic alloy particles.

BACKGROUND

With higher versatility of mobile instruments and electronization of automobiles, "chip-type" compact coil components or inductance components have found a wide range of use. In particular, laminated inductance components (laminated inductors), which can be thinned, are recently being developed for power devices passing a large electric current.

To allow for a large electric current, it is attempted to replace a magnetic portion of a laminated inductor conventionally made of NiCuZn-based ferrite with that made of a FeCrSi alloy having a higher saturation magnetic flux density. However, a FeCrSi alloy has a lower volume resistivity than the conventionally used ferrite, and therefore, it is necessary to increase its volume resistivity.

To overcome this problem, Japanese Patent Application Publication No. 2010-62424 (the "'424 Publication") discloses a method of fabricating an electronic component including adding glass composed mainly of $SiO_2$, $B_2O_3$, and ZnO into magnetic alloy powder including Fe, Cr, and Si, and firing the powder in a nonoxidizing atmosphere (700° C.). In this method, the insulation resistance of a fabricated product can be increased without increasing the resistance of a coil formed in the product.

However, in the method of '424 Publication, the volume resistivity of the magnetic portion is increased by the glass added into the magnetic alloy powder, and therefore, it is necessary to add a larger amount of glass in order to obtain a desired insulation resistance of the magnetic portion. As a result, the filling ratio of the magnetic alloy power is reduced, making it difficult to obtain high inductance characteristics. This problem is more significant as the inductor is thinner.

The magnetic alloy powder forming the magnetic portion has primarily been intended to have a high magnetic permeability and has been including particles having as large a diameter as possible, as long as such particles do not restrict other characteristics of the magnetic alloy powder. However, since large diameter particles tend to produce a large surface roughness, the thickness of a stacked layer was enlarged in accordance with the particle diameter. For example, the thickness of a stacked layer was varied so as to include six or more particles having a diameter of 10 μm or five or more particles having a diameter of 6 μm arranged in the stacking direction. This was in order to prevent reduction of magnetic permeability caused by the magnetic alloy powder having a small particle diameter, as described above.

SUMMARY

In view of the circumstances described above, one object of the present invention is to provide a laminated inductor having a reduced thickness but retaining magnetic characteristics and insulation quality.

To achieve the above object, a laminated inductor according to an embodiment of the present invention comprises at least one first magnetic layer, an internal conductor, a plurality of second magnetic layers, a plurality of third magnetic layers, and a pair of external electrodes. The at least one first magnetic layer, and includes three or more magnetic alloy particles arranged in the one axial direction and a first oxide film binding the magnetic alloy particles together and containing a first component including one or both of Cr and Al. The three or more magnetic alloy particles have an average particle diameter of 4 μm or smaller. The internal conductor includes a plurality of conductive patterned portions. The plurality of conductive patterned portions are electrically connected to each other via the at least one first magnetic layer, the plurality of conductive patterned portions being disposed so as to be opposed to each other in the one axial direction across the at least one first magnetic layer, each of the plurality of conductive patterned portions constituting a part of a coil wound around the one axial direction. The plurality of second magnetic layers are composed of magnetic alloy particles, the plurality of second magnetic layers being disposed around the plurality of conductive patterned portions so as to be opposed to each other in the one axial direction across the at least one first magnetic layer. The plurality of third magnetic layers are composed of magnetic alloy particles, the plurality of third magnetic layers being disposed so as to be opposed to each other in the one axial direction across the at least one first magnetic layer, the plurality of second magnetic layers, and the internal conductor. The pair of external electrodes are electrically connected to the internal conductor.

In the above laminated inductor, the at least one first magnetic layer disposed between the plurality of conductive patterned portions has a thickness of 4 to 19 μm, and the three or more magnetic alloy particles arranged in the thickness direction thereof are bound together via the first oxide film. Therefore, the entire thickness of the laminated inductor can be reduced without reduction in the magnetic characteristic and the insulation quality.

The at least one first magnetic layer may further include a second oxide film disposed between the magnetic alloy particles and the first oxide film. The second oxide film contains a second component including one or both of Si and Zr.

The magnetic alloy particles constituting the at least one first magnetic layer, the plurality of second magnetic layers, and the plurality of third magnetic layers may contain the first component, the second component, and Fe, with a ratio of the second component to the first component being larger than 1.

The magnetic alloy particles constituting the plurality of second magnetic layers and the plurality of third magnetic layers may contain 1.5 to 4 wt % of the first component and 5 to 8 wt % of the second component.

The at least one first magnetic layer, the plurality of second magnetic layers, and the plurality of third magnetic layers may include a resin material between the respective magnetic alloy particles.

The at least one first magnetic layer, the plurality of second magnetic layers, and the plurality of third magnetic layers may include a phosphorus element between the respective magnetic alloy particles.

As described above, the present invention provides a laminated inductor having a reduced entire thickness but retaining magnetic characteristics and insulation quality.

DESCRIPTION OF EXAMPLE EMBODIMENTS

The present invention may provide a laminate made of small diameter particles and having high magnetic characteristics and insulation quality, instead of forming a magnetic portion of large diameter particles as has been practiced conventionally. More specifically, three or more magnetic particles may be arranged between conductive patterned portions of an internal conductor to ensure the insulation quality between the conductive patterned portions of the internal conductor and allow reduction of thickness of the component. The present invention also makes it possible to find a range of particle diameters within which magnetic permeability is not reduced, so as to achieve high performance.

The embodiments of the present invention will be hereinafter described with reference to the drawings.

Figure 1:
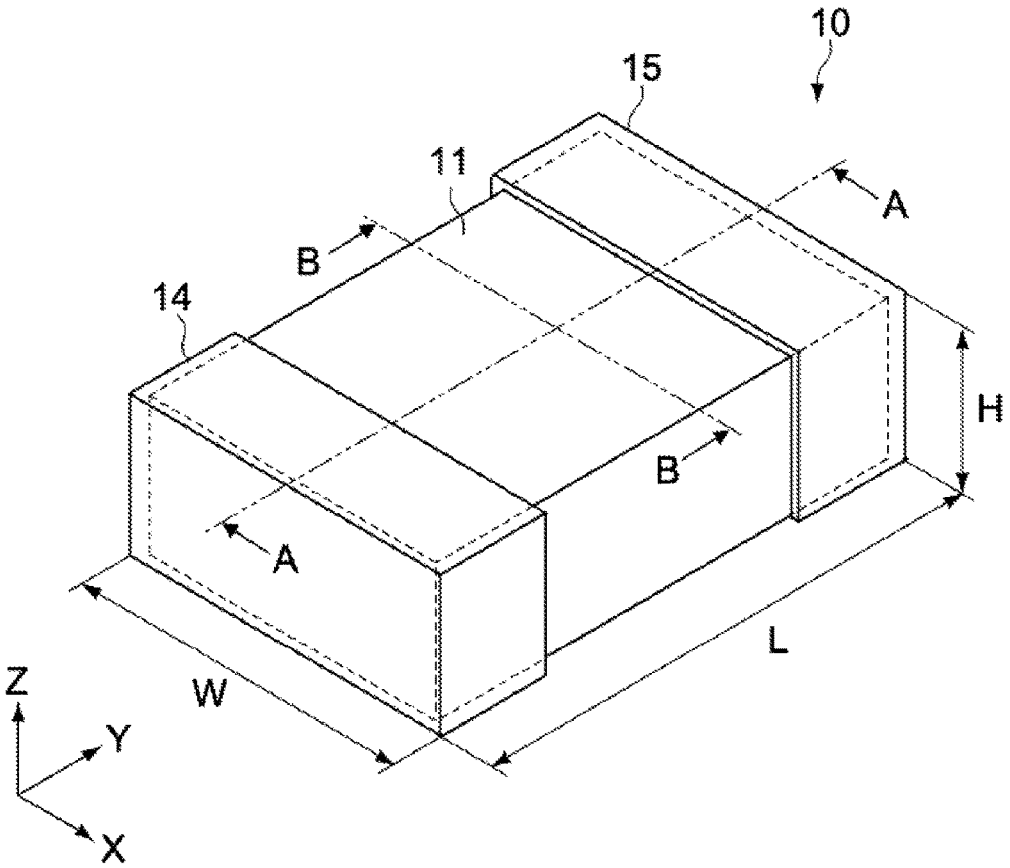
FIG. 1 is a perspective view of the entirety of a laminated inductor according to an embodiment of the invention.
Figure 2:
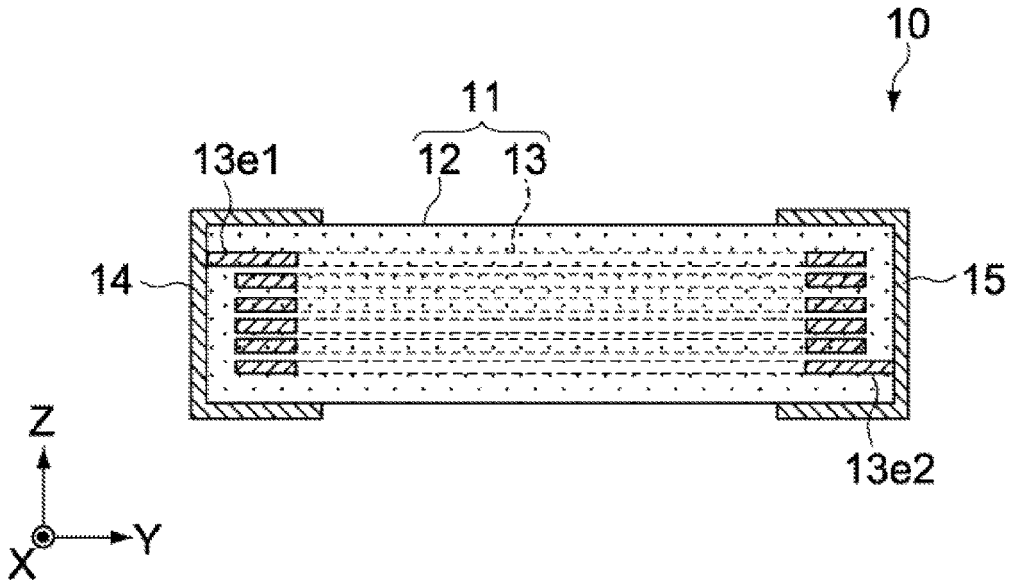
FIG. 2 is a sectional view along the line A-A in FIG. 1.

FIG. 1 is a perspective view of the entirety of a laminated inductor according to an embodiment of the invention. FIG. 2 is a sectional view along the line A-A in FIG. 1.

<Entire Configuration of Laminated Inductor>

As shown in FIG. 1, a laminated inductor 10 of the present embodiment may include a component body 11 and a pair of external electrodes 14, 15. The component body 11 may have a rectangular parallelepiped shape with a width W in the X axis direction, a length L in the Y axis direction, and a height H in the Z axis direction. The pair of external electrodes 14, 15 may be disposed on the two end surfaces of the component body 11 opposed with each other in the lengthwise direction of the component body 11 (the Y axis direction).

The dimensions of parts of the component body 11 are not particularly limited. In the embodiment, the length L may be 1.6 to 2 mm, the width W may be 0.8 to 1.2 mm, and the height H may be 0.4 to 0.6 mm.

As shown in FIG. 2, the component body 11 may include a magnetic portion 12 having a rectangular parallelepiped shape, and a spiral coil portion 13 (internal conductor) embedded in the magnetic portion 12.

Figure 3:
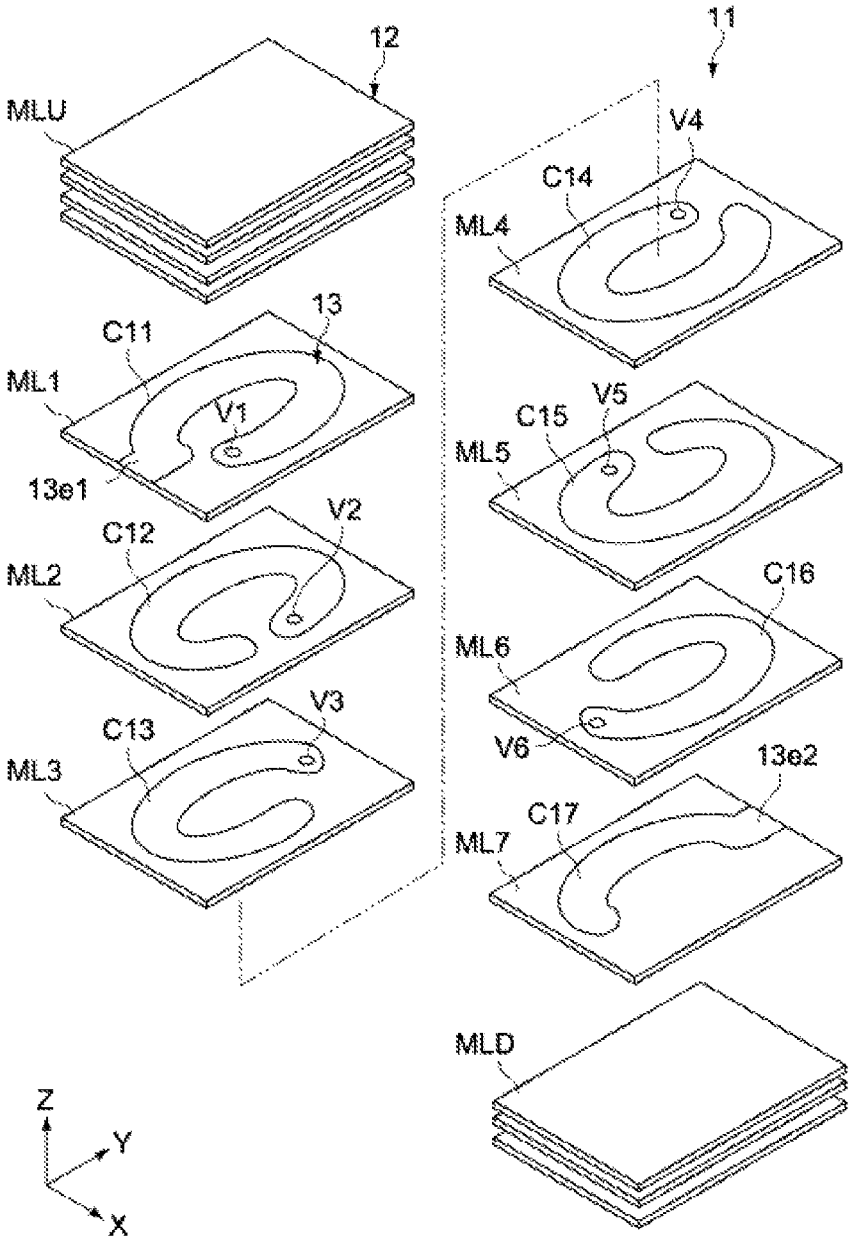
FIG. 3 is an exploded perspective view of a component body of the laminated inductor.
Figure 4:
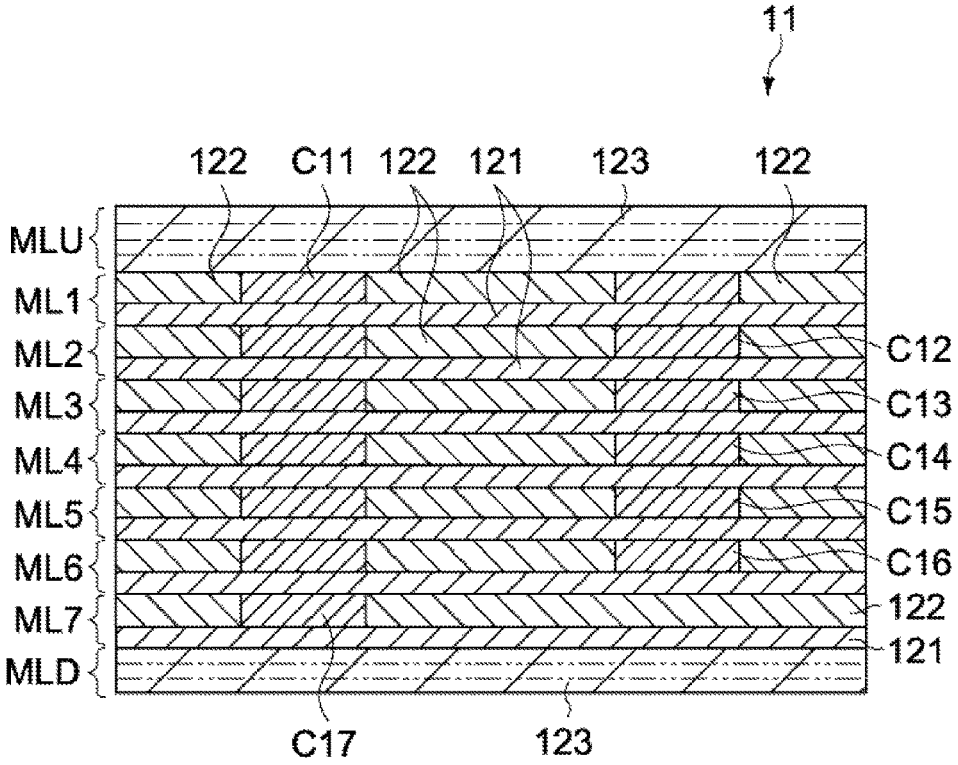
FIG. 4 is a sectional view along the line B-B in FIG. 1.

FIG. 3 is an exploded perspective view of the component body 11. FIG. 4 is a sectional view along the line B-B in FIG. 1.

As shown in FIG. 3, the magnetic portion 12 may include a plurality of magnetic body layers MLU, ML1 to ML7, and MLD stacked in the height direction (the Z axis direction) and integrated together. The magnetic body layers MLU and MLD may constitute the top and bottom cover layers (third magnetic layers) of the magnetic portion 12, respectively. The magnetic body layers ML1 to ML7 may constitute a conductive layer including a coil 13. As shown in FIG. 4, the magnetic body layers ML1 to ML7 may include first magnetic layers 121, second magnetic layers 122, and conductive patterned portions C11 to C17.

The first magnetic layers 121 may be inter-conductor layers placed between adjacent upper and lower conductive patterned portions C11 to C17. The first magnetic layers 121 may be formed of a magnetic material having soft magnetic characteristics, the magnetic material being formed of magnetic alloy particles. The soft magnetic characteristics of the magnetic material may herein include a coercive force Hc of 250 A/m or less.

The magnetic alloy particles may include Fe, a first component, and a second component. The first component may include at least one selected from the group consisting of Cr and Al, and the second component may include at least one selected from the group consisting of Si and Zr. In the embodiment, the first component may be Cr, and the second component may be Si. Therefore, the magnetic alloy particles may be FeCrSi alloy particles. The magnetic alloy particles may typically include 1.5 to 5 wt % Cr, 3 to 10 wt % Si, and the remaining percentage of Fe that total 100%, excluding impurities.

The first magnetic layers 121 may include a first oxide film binding the magnetic alloy particles together. The first oxide film may include the first component, which may be $Cr_2O_3$ in the embodiment. The first magnetic layers 121 may further include a second oxide film placed between the magnetic alloy particles and the first oxide film. The second oxide film may include the second component, which may be $SiO_2$ in the embodiment.

Thus, if the first magnetic layers 121 have a thickness as small as 19 μm or less, a required dielectric voltage can be obtained between the conductive patterned portions C11 to C17. Since the first magnetic layers 121 can have a reduced thickness, the conductive patterned portions C11 to C17 can be formed thick, thereby to reduce the direct current resistance of the coil 13.

The conductive patterned portions C11 to C17 may be disposed on the first magnetic layers 121. As shown in FIG. 2, each of the conductive patterned portions C11 to C17 may constitute a part of the coil winding around the Z axis. The conductive patterned portions C11 to C17 may be electrically connected through vias V1 to V6 in the Z axis direction to form the coil 13. The conductive patterned portion C11 in the magnetic body layer ML1 may include a lead end **13*e*1 electrically connected to the external electrode 14, and the conductive patterned portion C17 in the magnetic body layer ML7 may include a lead end 13*e*2 electrically connected to the external electrode 15**.

The second magnetic layers 122 may be composed of the same magnetic alloy particles (the FeCrSi alloy particles) as the first magnetic layers 121. The second magnetic layers 122 may be opposed to each other across the first magnetic layers 121 in the Z axis direction, and may be disposed around the conductive patterned portions C11 to C17 on the first magnetic layers 121, respectively. The thickness of the second magnetic layers 122 in the magnetic body layers ML1 to ML7 may be typically the same as, or may be different from, that of the conductive patterned portions C11 to C17.

The third magnetic layers 123 may be composed of the same magnetic alloy particles (the FeCrSi alloy particles) as the first magnetic layers 121. The third magnetic layers 123 may correspond to the top magnetic body layer MLU and the bottom magnetic body layer MLD, and may be opposed to each other in the Z axis direction across the first magnetic layers 121, the second magnetic layers 122, and the conductive patterned portions C11 to C17 (the coil 13) in the magnetic body layers ML1 to ML7. Each of the magnetic body layers MLU, MLD may be composed of a laminate including a plurality of third magnetic layers 123, the number of which is not particularly limited. The first magnetic layer 121 in the magnetic body layer ML7 may be constituted by the third magnetic layer 123 disposed in the topmost layer of the magnetic body layer MLD. Also, the bottom layer of the magnetic body layer MLU may be constituted by the first magnetic layer 121.

As described above, the magnetic alloy particles (FeCrSi alloy particles) constituting the first to third magnetic layers 121-123 may be provided on the surfaces thereof with an oxide film (the first oxide film and the second oxide film) of the FeCrSi alloy particles serving as an insulating film. The FeCrSi alloy particles in the magnetic layers 121-123 may be bound together via the oxide films, and the FeCrSi alloy particles near the coil 13 may be tightly adhered to the coil 13 via the oxide films. The oxide films may typically include at least one selected from the group consisting of $Fe_3O_4$ being a magnetic substance and $Fe_2O_3$, $Cr_2O_3$, and $SiO_2$ being nonmagnetic substances.

Any magnetic alloy particles other than FeCrSi, such as FeCrZr, FeAlSi, FeTiSi, FeAlZr, and FeTiZr, can be used as long as the magnetic alloy particles are composed mainly of Fe and include one or both of Si and Zr (the second component) and one or more elements (the first component) other than Si and Zr that are more susceptible to oxidation than Fe. More preferably, the magnetic alloy material may include 85 to 95.5 wt % Fe and the one or more elements (the first component) other than Si and Zr (the second component) that are more susceptible to oxidation than Fe, and the ratio of the second component to the first component (the second component/the first component) may be larger than 1. With such a magnetic alloy material, the oxide films may be formed stably to have a high insulation quality even if oxide films are heat-treated at a low temperature.

If the ratio of the second component to the first component (the second component/the first component) in the magnetic alloy particles constituting the first to third magnetic layers 121-123 is larger than 1, these magnetic alloy particles may have higher resistance and thus produce a better quality factor, contributing to improvement in efficiency of circuit operation.

If the first component is Cr, the percentage of Cr content in the FeCrSi-based alloy may be 1 to 5 wt %, for example. The presence of Cr may favorably produce passivity and restrain excess oxidation during heat treatment and develop strength and insulation resistance. If the Cr content exceeds 5 wt %, the magnetic characteristics may tend to reduce. On the other hand, if the Cr content is less than 1 wt %, the magnetic alloy particles may unfavorably expand more significantly by oxidation to produce fine separation between the first magnetic layers 121 and the second magnetic layers 122. The percentage of Cr content may preferably be 1.5 to 3.5 wt %.

The percentage of Si content in the FeCrSi-based alloy may be 3 to 10 wt %. As the Si content is larger, the magnetic layers may have higher resistance and higher magnetic permeability to produce more efficient inductor characteristics (a higher quality factor). As the Si content is smaller, the magnetic layers can be shaped better. The Si content may be adjusted in consideration of the above. If combining high resistance and high magnetic permeability, even a small part can have excellent direct current resistance. Therefore, the Si content may preferably be 4 to 8 wt %. Such Si content may further improve frequency characteristics in addition to the quality factor, making it possible to support higher frequencies in the future.

In the FeCrSi-based alloy, the entire portion other than Si and Cr may preferably be Fe, excluding inevitable impurities. In addition to Fe, Si, and Cr, the FeCrSi-based alloy can include metals such as Al, Mg, Ca, Ti, Mn, Co, Ni, and Cu and nonmetals such as P (phosphorus), S (sulfur), and C (carbon).

The magnetic layers 121-123 may have different thicknesses (along the Z axis direction, as for the thicknesses hereinafter referred to) and different average particle diameters (median diameters) of the magnetic alloy particles on a volume basis.

In the embodiment, the first magnetic layers 121 may have a thickness of 4 to 19 μm. The first magnetic layers 121 may have a thickness corresponding to the distance between the conductive patterned portions C11 to C17 (the distance between the conductors) opposed to each other in the Z axis direction across the first magnetic layers 121. In the embodiment, the magnetic alloy particles constituting the first magnetic layers 121 may have such an average particle diameter that three or more magnetic alloy particles can be arranged in the thickness direction (the Z axis direction) within the thickness. For example, the average particle diameter may be 1 to 4 μm. In particular, the magnetic alloy particles may preferably have an average particle diameter of 2 to 3 μm, because such magnetic alloy particles may achieve a small thickness and high magnetic permeability of the magnetic layers.

Figure 5:
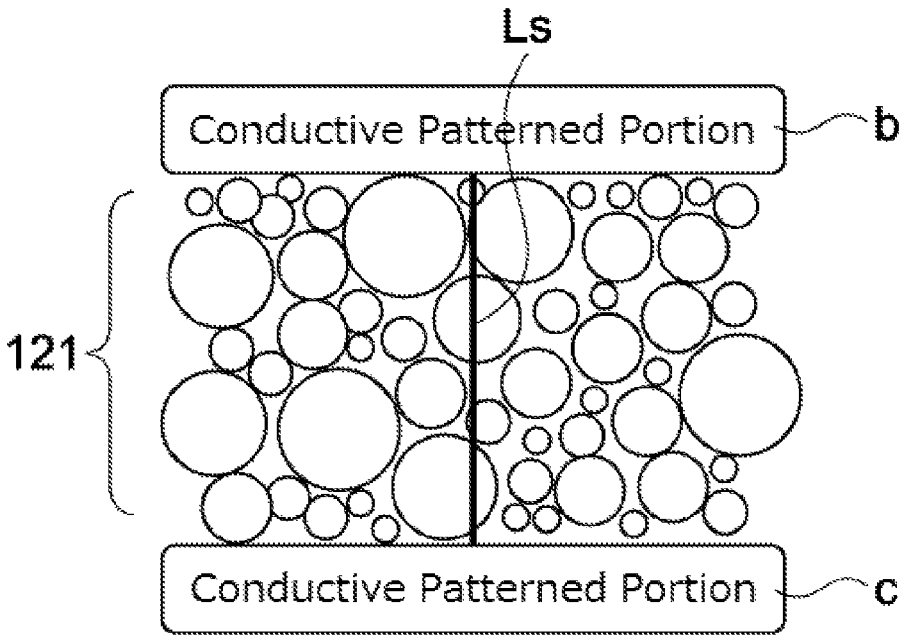
FIG. 5 is a schematic sectional view of magnetic alloy particles arranged in a thickness direction of a first magnetic layer of the laminated inductor.

The above-described size that allows three or more magnetic alloy particles to be arranged in the thickness direction is not necessarily based on the arrangement where the three or more magnetic alloy particles are arranged straight along the thickness direction. For example, FIG. 5 schematically shows an exemplary arrangement where five magnetic alloy particles are arranged. That is, the number of the magnetic alloy particles arranged in the thickness direction may refer to the number of particles crossing a reference line Ls parallel to the thickness direction between the conductive patterned portions (the conductive patterned portions b, c of the internal conductor), this number being five in the drawing.

If the thickness of the first magnetic layers 121 is less than 4 μm, the insulation quality of the first magnetic layers 121 may be reduced to a level where the dielectric voltage between the conductive patterned portions C11 to C17 cannot be obtained. On the other hand, if the thickness of the first magnetic layers 121 exceeds 19 μm, this unnecessarily large thickness may make it difficult to reduce the thickness of the component body 11 and thus the laminated inductor 10.

If the average particle diameter of the magnetic alloy particles constituting the first magnetic layers 121 is as relatively small as 2 to 5 μm, the surface area of the magnetic alloy particle may be large enough to increase the dielectric voltage between the magnetic alloy particles bound together via the oxide films described above. Thus, even if the first magnetic layers 121 have a thickness as relatively small as 4 to 19 μm, a desired dielectric voltage can be obtained between the conductive patterned portions C11 to C17.

As the average particle diameter is smaller, the surfaces of the first magnetic layers 121 can be made smoother. Thus, the first magnetic layers 121 may include a regular number of particles arranged in the thickness direction and may have a desired dielectric voltage even with a reduced thickness. Also, the first magnetic layers 121 can be securely covered with the second magnetic layers 122 and the conductive patterned portions C11 to C17 contacting the first magnetic layers 121.

Further, since the first magnetic layers 121 can have a reduced thickness, the conductive patterned portions C11 to C17 can be formed thick. With such an arrangement, the direct current resistance of the coil 13 can be reduced, which is advantageous particularly to power devices handling a large amount of power.

The second magnetic layers 122 may have a thickness of, for example, 30 to 60 μm, and each of the magnetic body layers MLU, MLD may have a thickness of, for example, 50 to 120 μm (the entire thickness of a third magnetic layer 123). The magnetic alloy particles constituting the second magnetic layers 122 and the third magnetic layers 123 may have an average particle diameter of, for example, 4 to 20 μm.

In the embodiment, the second and third magnetic layers 122, 123 may be constituted by magnetic alloy particles that have a larger average particle diameter than the magnetic alloy particles constituting the first magnetic layers 121. More specifically, the second magnetic layers 122 may be constituted by magnetic alloy particles having an average particle diameter of 6 μm, and the third magnetic layers 123 may be constituted by magnetic alloy particles having an average particle diameter of 4 μm. In particular, if the average particle diameter of the magnetic alloy particles constituting the second magnetic layers 122 is larger than the average particle diameter of the magnetic alloy particles constituting the first magnetic layers 121, the magnetic permeability of the entire magnetic portion 12 may be high enough to reduce the direct current resistance while restraining the impact of losses and frequency characteristics.

Each of the second magnetic layers 122 and the third magnetic layers 123 constituted by the magnetic alloy particles may include ten or more magnetic alloy particles arranged between the coil 13 and the external electrodes 14, 15, and the first oxide film binding the magnetic alloy particles together and containing the first component including one or both of Cr and Al. The insulation between the coil 13 and the external electrodes 14, 15 can be obtained using the magnetic material including ten or more magnetic alloy particles arranged therebetween.

The coil 13 may be composed of an electrically conductive material and may include a lead end **13*e*1 electrically connected to the external electrode 14 and a lead end 13*e*2 electrically connected to the external electrode 15. The coil 13** may be composed of a fired conductive paste, and more specifically, a fired silver (Ag) paste in the embodiment.

The coil 13 may spirally wind around the height direction (the Z axis direction) in the magnetic portion 12. As shown in FIG. 3, the coil 13 may include seven conductive patterned portions C11 to C17 formed in the magnetic body layers ML1 to ML7 to have respective shapes, and six vias V1 to V6 connecting the conductive patterned portions C11 to C17 in the Z axis direction. These members may be integrated together into a spiral shape. The conductive patterned portions C12 to C16 may correspond to turning portions of the coil 13, and the conductive patterned portions C11, C17 may correspond to lead portions of the coil 13. The coil 13 shown has about five and a half turns, but this is not limitative.

As shown in FIG. 3, the coil 13 may have an oval shape as viewed from the Z axis direction, and the long axis thereof may be in parallel with the lengthwise direction of the magnetic portion 12. Thus, the path of electric current through the coil 13 may be shortest, and the direct current resistance may be reduced Typically, the oval shape may herein refer to an ellipse, an oblong (two semicircles connected with straight lines), a rounded corner rectangle, etc. It may also be possible that the coil 13 have a substantially rectangular shape as viewed from the Z axis direction.

<Fabrication Method of Laminated Inductor>

Figure 6:
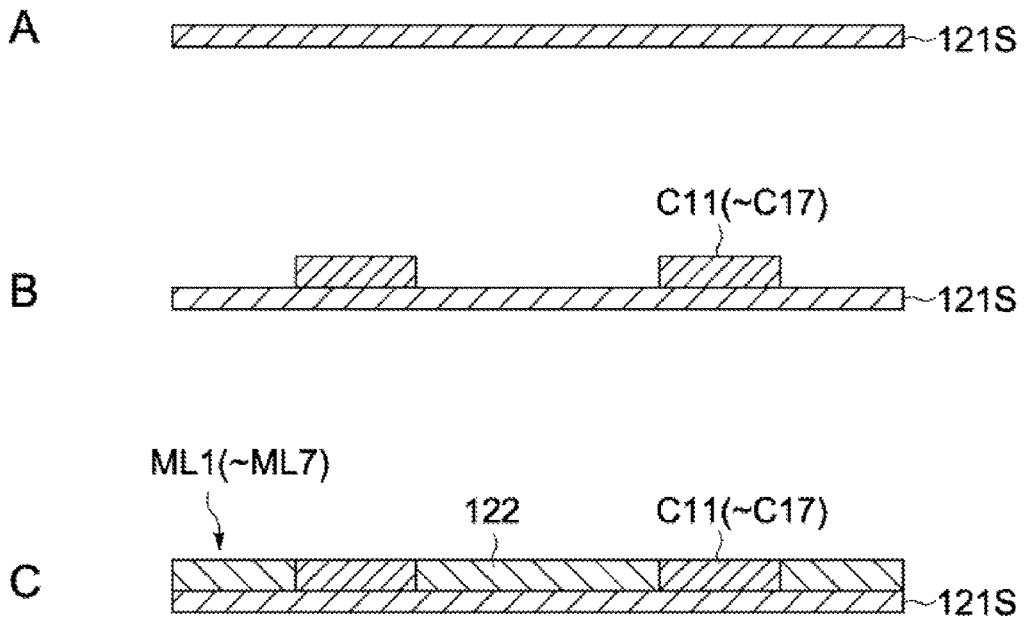
FIG. 6 is a schematic sectional view of main parts for illustrating a fabrication method of magnetic body layers of the laminated inductor.

A method for fabricating the laminated inductor 10 will now be described. FIG. 6 is a schematic sectional view of main parts for illustrating a fabrication method of the magnetic body layers ML1 to ML7 of the laminated inductor 10.

The fabrication method of the magnetic body layers ML1 to ML7 may include forming the first magnetic layers 121, forming the conductive patterned portions C11 to C17, and forming the second magnetic layers 122.

(Formation of First Magnetic Layers)

In forming the first magnetic layers 121, a coating machine (not shown) such as a doctor blade or a die coater may be used to apply a previously prepared magnetic paste (slurry) onto the surface of a plastic base film (not shown). Next, a drier (not shown) such as a hot-gas drier may be used to dry the base film at about 8° C. for about five minutes to produce the first to seventh magnetic sheets 121S corresponding to the magnetic body layers ML1 to ML7, respectively (see section A of FIG. 6). These magnetic sheets 121S may have a size that can be separated into a large number of first magnetic layers 121.

The magnetic paste used herein may contain 75 to 85 wt % FeCrSi alloy particles, 13 to 21.7 wt % butyl carbitol (solvent), and 2 to 3.3 wt % polyvinyl butyral (binder). This composition may be adjusted by the average particle diameter (median diameter) of the FeCrSi particles. For example, the respective percentages may be 85 wt %, 13 wt %, and 2 wt % for an average particle diameter (median diameter) of FeCrSi alloy particles of 3 μm or more, 80 wt %, 17.3 wt %, and 2.7 wt % for an average particle diameter of 1.5 to 3 μm, and 75 wt %, 21.7 wt %, and 3.3 wt % for an average particle diameter of less than 1.5 μm. The average particle diameter of the FeCrSi alloy particles may be selected in accordance with the thickness of the first magnetic layers 121, etc. The FeCrSi alloy particles may be prepared by the atomization method, for example.

As described above, the first magnetic layers 121 may have a thickness of 4 to 19 μm and may be configured such that three or more magnetic alloy particles (FeCrSi alloy particles) are arranged along the thickness direction. In the embodiment, the magnetic alloy particles may preferably have such an average particle diameter that d50 (median diameter) is 1 to 4 μm on a volume basis. The magnetic alloy particles may be measured for d50 thereof with the particle size distribution apparatus using the laser diffraction scattering method (e.g., Micro-track from Nikkiso Co., Ltd)

Next, a boring machine (not shown) such as a punching machine or a laser processing machine is used to bore through-holes (not shown) corresponding to the vias V1 to V6 (see FIG. 3) in the first to sixth magnetic sheets 121S corresponding to the magnetic body layers ML1 to ML6, respectively, in a predetermined arrangement. The arrangement of the through-holes may be preset such that when the first to seventh magnetic sheets 121S are stacked together, the through-holes filled with a conductive material and the conductive patterned portions C11 to C17 constitute an internal conductor.

(Formation of Conductive Patterned Portions)

Next, as shown in section B of FIG. 6, the conductive patterned portions C11 to C17 may be formed on the first to seventh magnetic sheets 121S, respectively.

As to the conductive patterned portion C11, a previously prepared conductive paste may be printed on the surface of the first magnetic sheet 121S corresponding to the magnetic body layer ML1 using a printer (not shown) such as a screen printer or a gravure printer. Further, the above conductive paste may be filled into a through-hole corresponding to the via V1. Then, a drier (not shown) such as a hot-gas drier may be used to dry the first magnetic sheet 121S at about 8° C. for about five minutes to produce the first print layer corresponding to the conductive patterned portion C11 in a predetermined arrangement.

The conductive patterned portions C12 to C17 and the vias V2 to V6 may also be formed by the same method as described above. Thus, the second to seventh print layers corresponding to the conductive patterned portions C12 to C17 may be formed on the surfaces of the second to seventh magnetic sheets 121S corresponding to the magnetic body layers ML2 to ML7.

The conductive paste used herein may contain 85 wt % Ag particles, 13 wt % butyl carbitol (solvent), and 2 wt % polyvinyl butyral (binder). The Ag particles may have a d50 value of about 5 μm.

(Formation of Second Magnetic Layers)

Next, as shown in section C of FIG. 6, the second magnetic layers 122 may be formed on the first to seventh magnetic sheets 121S.

In forming the second magnetic layers 122, a printer (not shown) such as a screen printer or a gravure printer may be used to apply a previously prepared magnetic paste (slurry) around the conductive patterned portions C11 to C17 on the first to seventh magnetic sheets 121S. Then, a drier (not shown) such as a hot-gas drier may be used to dry the magnetic paste at about 8° C. for about five minutes.

The magnetic paste used herein may contain 85 wt % FeCrSi alloy particles, 13 wt % butyl carbitol (solvent), and 2 wt % polyvinyl butyral (binder).

The thickness of the second magnetic layers 122 may be adjusted to be the same as or different by 20% or lower from that of the conductive patterned portions C11 to C17, such that almost identical planes may be arranged in the stacking direction to form a magnetic portion 12 with no steps in any of the magnetic layers and no misalignment between the magnetic layers. As described above, the second magnetic layers 122 may be composed of the magnetic metal particles (the FeCrSi alloy particles) and may have a thickness of 30 to 60 μm. In the embodiment, the average particle diameter of the magnetic alloy particles constituting the second magnetic layers 122 may be larger than the average particle diameter of the magnetic alloy particles constituting the first magnetic layers 121. For example, the average particle diameter of the magnetic alloy particles constituting the first magnetic layers 121 may be 1 to 4 μm, and the average particle diameter of the magnetic alloy particles constituting the second magnetic layers 122 may be 4 to 6 μm.

As described above, the first to seventh sheets corresponding to the magnetic body layers ML1 to ML7 may be produced (see section C of FIG. 6).

(Formation of Third Magnetic Layers)

In forming the third magnetic layers 123, a coating machine (not shown) such as a doctor blade or a die coater may be used to apply a previously prepared magnetic paste (slurry) onto the surface of a plastic base film (not shown). Next, a drier (not shown) such as a hot-gas drier may be used to dry the base film at about 8° C. for about five minutes to produce magnetic sheets corresponding to the third magnetic layers 123 constituting the magnetic body layers MLU, MLD. These magnetic sheets may have a size that can be separated into a large number of third magnetic layers 123.

The magnetic paste used herein may contain 85 wt % FeCrSi alloy particles, 13 wt % butyl carbitol (solvent), and 2 wt % polyvinyl butyral (binder).

As described above, the third magnetic layers 123 may have such a thickness that the thicknesses of the magnetic body layers MLU, MLD constituted by the stacked third magnetic layers 123 are 50 to 120 μm. In the embodiment, the average particle diameter of the magnetic alloy particles constituting the third magnetic layers 123 may be the same as or smaller than the average particle diameter of the magnetic alloy particles constituting the first magnetic layers 121 (1 to 4 μm) or the average particle diameter of the magnetic alloy particles constituting the second magnetic layers 122 (6 μm), which may be 4 μm for example. If the average particle diameter for the third magnetic layers 123 is the same as the average particle diameter for the first magnetic layers 121 or the second magnetic layers 122, the magnetic permeability may be higher, whereas if smaller, the third magnetic layers 123 may be thinner.

(Stacking and Cutting)

Next, a sucking conveyor and a pressing machine (both not shown) may be used to stack together the first to seventh sheets (corresponding to the magnetic body layers ML1 to ML7) and the eighth sheets (corresponding to the magnetic body layers MLU, MLD) in the order shown in FIG. 3 for thermo-compression bonding to produce a laminate.

Next, a cutting machine (not shown) such as a dicing machine or a laser processing machine may be used to cut the laminate into a size of the component body to produce unprocessed chips (including the magnetic portion and the coil prior to heating).

(Degreasing and Formation of Oxide Films)

Next, a heater (not shown) such as a firing furnace may be used to heat a large number of unheated chips in a lump in an oxidizing atmosphere such as the air. This heating process may include degreasing and formation of oxide film. The degreasing may be performed at about 300° C. for about one hour, and the formation of oxide film may be performed at about 700° C. for about two hours.

The unheated chips prior to degreasing may have a large number of fine clearances between the FeCrSi alloy particles in the unheated magnetic material, and the fine clearances may include a binder, etc. However, since the binder, etc. may disappear during degreasing, the fine clearances may turn into bores (voids) after degreasing. Further, there may be a large number of fine clearances between Ag particles in the coil prior to heating, and these fine clearances may include a binder, etc. which may disappear during degreasing.

In the formation of oxide films following the degreasing, the FeCrSi alloy particles in the unheated magnetic material may congregate densely to produce the magnetic portion 12 (see FIGS. 1 and 2), and simultaneously, each of the FeCrSi alloy particles may be provided on the surface thereof with an oxide film of the particle. Further, the Ag particles in the unheated coil may be sintered to produce the coil 13 (see FIGS. 1 and 2), thereby to complete the component body 11.

(Formation of External Electrodes)

Next, a coater (not shown) such as a dip coater or a roller coater may be used to apply a previously prepared conductive paste onto both lengthwise ends of the component body 11, which may be then fired at about 650° C. for about 20 minutes using a heater (not shown) such as a firing furnace. By the firing, the solvent and the binder may disappear and the Ag particles may be sintered to produce the external electrodes 14, 15 (see FIGS. 1 and 2).

The conductive paste used herein for the external electrodes 14, 15 may contain 85 wt % or more Ag particles, and glass, butyl carbitol (solvent), and polyvinyl butyral (binder). The Ag particles may have a d50 value of about 5 μm.

(Resin Impregnation)

Next, the magnetic portion 12 may be impregnated with a resin. In the magnetic portion 12, there are spaces between the magnetic alloy particles forming the magnetic portion 12. The resin impregnation may be to fill in these spaces. More specifically, the obtained magnetic portion 12 may be immersed into a solution containing a resin material of a silicone resin to fill the resin material into the spaces, and then the magnetic portion 12 may be heat-treated at 150° C. for 60 minutes to cure the resin material.

The impregnation with a resin may be performed by, e.g., immersing the magnetic portion 12 into a liquid of a resin material such as a liquid resin material or a solution of a resin material to lower the pressure, or applying a liquid of a resin material onto the magnetic portion 12 to allow penetration from the surface to the interior. As a result, the resin may be adhered to the exterior of the oxide films on the surface of the magnetic alloy particles to fill a part of the spaces between the magnetic alloy particles. This resin may favorably increase the strength and restrain the moisture absorbency. Because less moisture is allowed to penetrate the magnetic portion 12, reduction of insulation quality can be restrained particularly at high temperatures.

In addition, if plating is used to form the external electrodes, this resin may also restrain plating elongation and increase the yield. Examples of the resin material may include organic resins and silicone resins. More preferably, the resin material may include at least one selected from the group consisting of silicone-based resins, epoxy-based resins, phenol-based resins, silicate-based resins, urethane-based resins, imide-based resins, acrylic-based resins, polyester-based resins, and polyethylene-based resins.

(Phosphate Treatment)

To further increase the insulation quality, a phosphoric acid-based oxide may be formed on the surface of the magnetic alloy particles forming the magnetic portion 12. This process may include immersing the laminated inductor 10 having the external electrodes 14, 15 into a phosphate treatment bath, followed by cleansing with water and drying. Examples of the phosphate may include manganese salt, iron salt, and zinc salt. These phosphates may be used for the treatment in an appropriate concentration.

As a result, a phosphorus element can be observed between the magnetic alloy particles forming the magnetic portion 12. The phosphorus element may be present as a phosphoric acid-based oxide so as to fill a part of the spaces between the magnetic alloy particles. More specifically, since oxide films are present on the surface of the magnetic alloy particles, the phosphoric acid-based oxide may be formed in other portions having no oxide film where Fe may be replaced with phosphorus.

The presence of both the oxide films and the phosphoric acid-based oxide may ensure the insulation quality even if the magnetic alloy particles contain a higher proportion of Fe. In addition, this arrangement may also restrain plating elongation as with the resin impregnation. Further, the resin impregnation and the phosphate treatment may be combined together to produce a synergetic effect of improving the humidity-resistance in addition to the insulation quality. This combination may be achieved by either performing the resin impregnation and then the phosphate treatment or performing the phosphate treatment and then the resin impregnation, which may produce the same effect.

The final step may be plating. The plating may be performed by conventional electrodeposition, wherein metal films of Ni and Sn may be formed on the external electrodes 14, 15 formed previously by sintering Ag particles. Thus, the laminated inductor 10 may be produced.

EXAMPLES

Next, examples of the present invention will now be described.

Example 1

A laminated inductor was fabricated under the following condition to a rectangular parallelepiped shape with a length of about 1.6 mm, a width of about 0.8 mm, and a height of about 0.54 mm.

The first to third magnetic layers were produced from a magnetic paste containing FeCrSi-based magnetic alloy particles as a magnetic material. The first magnetic layers and the second magnetic layers may correspond to the first magnetic layers 121 and the second magnetic layers 122 in FIG. 4, respectively, and the third magnetic layers may correspond to the magnetic body layer MLU and the magnetic body layer MLD in FIG. 4 (as for the magnetic layers hereinafter referred to).

The composition of Cr and Si in the FeCrSi-based magnetic alloy particles constituting the first to third magnetic layers was 6Cr3Si (including 6 wt % Cr, 3 wt % Si, and the remaining percentage of Fe that total 100 wt %, excluding impurities, as for Example 2 and later Examples). The first magnetic layers had a thickness of 16 μm, and the magnetic alloy particles therein had an average particle diameter of 4 μm. The second magnetic layers had a thickness of 37 μm, and the magnetic alloy particles therein had an average particle diameter of 6 μm. The third magnetic layers had a thickness of 56 μm, and the magnetic alloy particles therein had an average particle diameter of 4.1 μm. Eight first magnetic layers and eight second magnetic layers were stacked alternately, and two third magnetic layers were disposed on both ends in the stacking direction.

The coil was printed with an Ag paste on the surface of the first magnetic layer to the same thickness as the second magnetic layer. As shown in FIG. 3, the coil included a plurality of turning portions and lead portions stacked together in the coil axis direction. The plurality of turning portions each had a coil length of about a five-sixths turn, and the lead portions had a predetermined coil length. The coil had 6.5 turns, and the thickness the coil was the same as that of the second magnetic layers.

The laminate of the magnetic layers (the magnetic portion) configured as described above was cut into a component body size and then subjected to a heat treatment at 300° C. (degreasing) and a heat treatment at 700° C. (formation of oxide films). Underlayers of the external electrodes were formed of an Ag paste on both ends of the magnetic portion in which end surfaces of the lead portions were exposed. Then, the magnetic portion was impregnated with a resin, and the underlayers of the external electrodes were subjected to Ni and Sn plating.

The laminated inductor fabricated as described above was evaluated for the number of the magnetic alloy particles arranged in the first magnetic layer in the thickness direction thereof, an electric current characteristic, and an withstanding voltage characteristic. The samples were first measured for an inductance value at measurement frequency of 1 MHz using a LCR meter, and the samples having an inductance value within 10% deviation from the designed inductance value (0.22 μH) were selected and subjected to the evaluation.

The number of the magnetic alloy particles were determined by SEM observation of the laminated inductor in the A-A section in FIG. 1. More specifically, the A-A section was ground or milled and then observed at a magnification of 1,000× to 5,000× at which an entire region between any two adjacent conductive patterned portions of the internal conductor can be viewed, so as to determine the distance between the respective widthwise middle points of the two conductive patterned portions of the internal conductor. The reason why the evaluation was performed on the A-A section was to evaluate the distance and the number of particles between the conductive patterned portions of the internal conductor on the side close to the external electrodes. As shown in FIG. 5, a perpendicular line (Ls) having a width of 1 μm was drawn from the middle point of the conductive patterned portion b toward the conductive patterned portion c, and the particles crossing the perpendicular line and having a diameter (a length in the perpendicular direction viewed in the section) equal to or greater than one-tenth of the distance between the conductive patterned portions b, c was counted. If the perpendicular line cannot be drawn, a straight line having a width of 1 μm was drawn along the shortest distance between the conductive patterned portion b and the conductive patterned portion c, and the particles crossing the straight line and having a diameter (a length in the perpendicular direction viewed in the section) equal to or greater than one-tenth of the shortest distance between the conductive patterned portions b, c was counted. This evaluation was performed on each pair of adjacent conductive patterned portions, and the smallest number of the particles was taken as the number of magnetic alloy particles arranged in the first magnetic layer.

The same samples were used for evaluation of the second magnetic layers and the third magnetic layers. For the second magnetic layers, a straight line having a width of 1 μm was drawn along the shortest distance from the surface of a second magnetic layer contacting a conductive patterned portion to a side surface of the second magnetic layer, and the particles crossing the straight line and having a diameter (a length in the perpendicular direction viewed in the section) equal to or greater than one-tenth of the shortest distance between the conductive patterned portions b, c was counted. For the third magnetic layers, a straight line having a width of 1 μm was drawn along the shortest distance from the surface of a third magnetic layer contacting a conductive patterned portion to an external electrode, and the particles crossing the straight line and having a diameter (a length in the perpendicular direction viewed in the section) equal to or greater than one-tenth of the shortest distance between the conductive patterned portions b, c was counted. This evaluation revealed that the number of particles was equal to or greater than ten in both the second magnetic layers and the third magnetic layers of any of Examples.

The quality factor was measured by a LCR meter at a measurement frequency of 1 MHz. The instrument used for the measurement was 4285A (from Keysight Technologies, Inc.).

The withstanding voltage characteristic was evaluated through electrostatic withstanding voltage test. The electrostatic withstanding voltage test was performed by applying a voltage to the samples through electrostatic discharge (ESD) test and determining whether there was a change in the characteristics. The test condition employed the human body model (HBM), and the test was performed in conformity to IEC61340-3-1. The test method will now be described in detail.

First, a LCR meter was used to determine the quality factor of the sample laminated inductor at 10 MHz, which was taken as an initial value (prior to the test). Next, a voltage was applied for a test (the first test) under the condition of a discharge capacity of 100 pF, a discharge resistance of 1.5 kΩ, a test voltage of 1 kV, and applying pulses once for each pole. Then, the quality factor was determined again. The samples exhibiting a numeric value equal to or greater than 70% of the initial value were determined to be passing, while those exhibiting a numeric value less than 70% of the initial value were determined to be failing. Next, a voltage was applied to the qualified samples for a test (the second test) under the condition of a discharge capacity of 100 pF, a discharge resistance of 1.5 kΩ, a test voltage of 1.2 kV, and applying pulses once for each pole. Then, the quality factor was determined again. The samples exhibiting a numeric value equal to or greater than 70% of the initial value were determined to be passing, while those exhibiting a numeric value less than 70% of the initial value were determined to be failing. Three samples were used for each evaluation. Samples passing the first test were determined to be qualified. Among such samples, those also passing the second test were classified as "A," and those failing the second test were classified as "B." The samples determined to be defective in the first test were classified to be disqualified (evaluation "C"). The instrument used for the measurement was 4285A (from Keysight Technologies, Inc.).

As a result of evaluation, the distance between the conductive patterned portions was 16 μm, the number of the magnetic alloy particles was four, the direct current resistance was 69 mΩ, the quality factor was 26, and the withstanding voltage characteristic (dielectric breakdown evaluation) was "A."

Example 2

A laminated inductor was fabricated under the same condition as Example 1, except that the first magnetic layers had a thickness of 12 μm, the magnetic alloy particles therein had an average particle diameter of 3.2 μm, the second magnetic layers had a thickness of 42 μm, and the third magnetic layers had a thickness of 52 μm. This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 12 μm, the number of the magnetic alloy particles was three, the direct current resistance was 60 mΩ, the quality factor was 30, and the withstanding voltage characteristic (dielectric breakdown evaluation) was "A."

Example 3

A laminated inductor was fabricated under the same condition as Example 1, except that the first magnetic layers had a thickness of 7 μm, the magnetic alloy particles therein had an average particle diameter of 1.9 μm, the second magnetic layers had a thickness of 46 μm, and the third magnetic layers had a thickness of 52 μm. This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 7.2 μm, the number of the magnetic alloy particles was three, the direct current resistance was 55 mΩ, the quality factor was 32, and the withstanding voltage characteristic (dielectric breakdown evaluation) was "A."

Example 4

A laminated inductor was fabricated under the same condition as Example 1, except that the first magnetic layers had a thickness of 7 μm, the magnetic alloy particles therein had an average particle diameter of 1 μm, the second magnetic layers had a thickness of 41 μm, the magnetic alloy particles therein had an average particle diameter of 4 μm, and the third magnetic layers had a thickness of 74 μm. This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 7.5 μm, the number of the magnetic alloy particles was seven, the direct current resistance was 63 mΩ, the quality factor was 29, and the withstanding voltage characteristic (dielectric breakdown evaluation) was "A."

Example 5

A laminated inductor was fabricated under the same condition as Example 1, except that the first magnetic layers had a thickness of 3.5 μm, the magnetic alloy particles therein had an average particle diameter of 1 μm, the second magnetic layers had a thickness of 42 μm, the magnetic alloy particles therein had an average particle diameter of 4 μm, and the third magnetic layers had a thickness of 82 μm. This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 4.0 μm, the number of the magnetic alloy particles was three, the direct current resistance was 61 mΩ, the quality factor was 30, and the withstanding voltage characteristic (dielectric breakdown evaluation) was "A."

Example 6

A laminated inductor was fabricated under the same condition as Example 3, except that the composition of Cr and Si in the FeCrSi-based magnetic alloy particles constituting the first to third magnetic layers was 4Cr5Si (including 4 wt % Cr, 5 wt % Si, and the remaining percentage of Fe that total 100 wt %). This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 7.2 μm, the number of the magnetic alloy particles was three, the direct current resistance was 55 mΩ, the quality factor was 33, and the withstanding voltage characteristic (dielectric breakdown evaluation) was "A."

Example 7

A laminated inductor was fabricated under the same condition as Example 3, except that the composition of Cr and Si in the FeCrSi-based magnetic alloy particles constituting the first to third magnetic layers was 2Cr7Si (including 2 wt % Cr, 7 wt % Si, and the remaining percentage of Fe that total 100 wt %), and the magnetic alloy particles in the first magnetic layers had an average particle diameter of 2 μm. This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 7.3 μm, the number of the magnetic alloy particles was three, the direct current resistance was 55 mΩ, the quality factor was 35, and the withstanding voltage characteristic (dielectric breakdown evaluation) was "A."

Example 8

A laminated inductor was fabricated under the same condition as Example 3, except that the composition of Cr and Si in the FeCrSi-based magnetic alloy particles constituting the first to third magnetic layers was 1.5Cr8Si (including 1.5 wt % Cr, 8 wt % Si, and the remaining percentage of Fe that total 100 wt %). This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 7.4 μm, the number of the magnetic alloy particles was three, the direct current resistance was 56 mΩ, the quality factor was 36, and the withstanding voltage characteristic (dielectric breakdown evaluation) was "A."

Example 9

A laminated inductor was fabricated under the same condition as Example 7, except that the composition of Cr and Si in the FeCrSi-based magnetic alloy particles constituting the first to third magnetic layers was 1Cr10Si (including 1 wt % Cr, 10 wt % Si, and the remaining percentage of Fe that total 100 wt %). This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 7.8 μm, the number of the magnetic alloy particles was four, the direct current resistance was 59 mΩ, the quality factor was 29, and the withstanding voltage characteristic (dielectric breakdown evaluation) was "B."

Example 10

A laminated inductor was fabricated under the same condition as Example 7, except that the composition of Al and Si in the FeAlSi-based magnetic alloy particles constituting the second to third magnetic layers was 4Al5Si (including 4 wt % Al, 5 wt % Si, and the remaining percentage of Fe that total 100 wt %). This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 7.3 μm, the number of the magnetic alloy particles was three, the direct current resistance was 55 mΩ, the quality factor was 33, and the withstanding voltage characteristic (dielectric breakdown evaluation) was "A."

Example 11

A laminated inductor was fabricated under the same condition as Example 7, except that the composition of Al and Si in the FeAlSi-based magnetic alloy particles constituting the first magnetic layers was 2Al7Si (including 2 wt % Al, 7 wt % Si, and the remaining percentage of Fe that total 100 wt %). This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 7.4 μm, the number of the magnetic alloy particles was three, the direct current resistance was 55 mΩ, the quality factor was 35, and the withstanding voltage characteristic (dielectric breakdown evaluation) was "A."

Example 12

A laminated inductor was fabricated under the same condition as Example 7, except that the composition of Al and Si in the FeAlSi-based magnetic alloy particles constituting the first magnetic layers was 1.5Al8Si (including 1.5 wt % Al, 8 wt % Si, and the remaining percentage of Fe that total 100 wt %). This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 7.4 μm, the number of the magnetic alloy particles was three, the direct current resistance was 56 mΩ, the quality factor was 36, and the withstanding voltage characteristic (dielectric breakdown evaluation) was "A."

Example 13

A laminated inductor was fabricated under the same condition as Example 3, except that the composition of Cr and Zr in the FeCrZr-based magnetic alloy particles constituting the first magnetic layers was 2Cr7Zr (including 2 wt % Cr, 7 wt % Zr, and the remaining percentage of Fe that total 100 wt %). This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 7.2 μm, the number of the magnetic alloy particles was three, the direct current resistance was 55 mΩ, the quality factor was 35, and the withstanding voltage characteristic (dielectric breakdown evaluation) was "A."

Example 14

A laminated inductor was fabricated under the same condition as Example 6, except that the composition of Cr and Si in the FeCrSi-based magnetic alloy particles constituting the first magnetic layers was 6Cr3Si (including 6 wt % Cr, 3 wt % Si, and the remaining percentage of Fe that total 100 wt %). This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 7 μm, the number of the magnetic alloy particles was three, the direct current resistance was 54 mΩ, the quality factor was 32, and the withstanding voltage characteristic (dielectric breakdown evaluation) was "A."

Example 15

A laminated inductor was fabricated under the same condition as Example 7, except that the composition of Cr and Si in the FeCrSi-based magnetic alloy particles constituting the first magnetic layers was 6Cr3Si (including 6 wt % Cr, 3 wt % Si, and the remaining percentage of Fe that total 100 wt %). This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 6.9 μm, the number of the magnetic alloy particles was three, the direct current resistance was 54 mΩ, the quality factor was 34, and the withstanding voltage characteristic (dielectric breakdown evaluation) was "A."

Example 16

A laminated inductor was fabricated under the same condition as Example 8, except that the composition of Cr and Si in the FeCrSi-based magnetic alloy particles constituting the first magnetic layers was 6Cr3Si (including 6 wt % Cr, 3 wt % Si, and the remaining percentage of Fe that total 100 wt %). This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 6.9 μm, the number of the magnetic alloy particles was three, the direct current resistance was 55 mΩ, the quality factor was 35, and the withstanding voltage characteristic (dielectric breakdown evaluation) was "A."

Example 17

A laminated inductor was fabricated under the same condition as Example 1, except that the first magnetic layers had a thickness of 13 μm, the magnetic alloy particles therein had an average particle diameter of 1.9 μm, the second magnetic layers had a thickness of 42 μm, and the third magnetic layers had a thickness of 48 μm. This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 13 μm, the number of the magnetic alloy particles was seven, the direct current resistance was 60 mΩ, the quality factor was 30, and the withstanding voltage characteristic (dielectric breakdown evaluation) was "A."

Example 18

A laminated inductor was fabricated under the same condition as Example 1, except that the first magnetic layers had a thickness of 17 μm, the magnetic alloy particles therein had an average particle diameter of 1.9 μm, the second magnetic layers had a thickness of 38 μm, and the third magnetic layers had a thickness of 48 μm. This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 17 μm, the number of the magnetic alloy particles was nine, the direct current resistance was 66 mΩ, the quality factor was 29, and the withstanding voltage characteristic (dielectric breakdown evaluation) was "A."

Example 19

A laminated inductor was fabricated under the same condition as Example 1, except that the first magnetic layers had a thickness of 19 μm, the magnetic alloy particles therein had an average particle diameter of 1.9 μm, the second magnetic layers had a thickness of 36 μm, and the third magnetic layers had a thickness of 48 μm. This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 19 μm, the number of the magnetic alloy particles was ten, the direct current resistance was 70 mΩ, the quality factor was 28, and the withstanding voltage characteristic (dielectric breakdown evaluation) was "A."

Comparative Example 1

A laminated inductor was fabricated under the same condition as Example 1, except that the first magnetic layers had a thickness of 24 μm, the magnetic alloy particles therein had an average particle diameter of 5 μm, the second magnetic layers had a thickness of 29 μm. This laminated inductor was evaluated under the same condition as Example 1 for the number of magnetic alloy particles arranged in the first magnetic layer in the thickness direction thereof, the electric current characteristic, and the withstanding voltage characteristic. As a result, the distance between the conductive patterned portions was 24 μm, the number of the magnetic alloy particles was four, the direct current resistance was 88 mΩ, the quality factor was 24, and the withstanding voltage characteristic (dielectric breakdown evaluation) was "A."

Table 1 shows the conditions of fabricating the samples of Examples 1 to 19 and Comparative Example 1, Table 2 shows the types of the magnetic materials (the compositions of the magnetic alloy particles) shown in Table 1, and Table 3 shows the evaluation results of the samples.

TABLE 1

| | First Magnetic Layer | | Second Magnetic Layer | | Third Magnetic Layer | |
|---|---|---|---|---|---|---|
| | Composition No. | Average Particle Diameter (μm) | Composition No. | Average Particle Diameter (μm) | Composition No. | Average Particle Diameter (μm) |
| Comparative Example 1 | 1 | 5 | 1 | 6 | 1 | 4 |
| Example 1 | 1 | 4.1 | 1 | 6 | 1 | 4 |
| Example 2 | 1 | 3.2 | 1 | 6 | 1 | 4 |
| Example 3 | 1 | 1.9 | 1 | 6 | 1 | 4 |
| Example 4 | 1 | 1 | 1 | 4 | 1 | 4 |
| Example 5 | 1 | 1 | 1 | 4 | 1 | 4 |
| Example 6 | 2 | 1.9 | 2 | 6 | 2 | 4 |
| Example 7 | 3 | 2 | 3 | 6 | 3 | 4 |
| Example 8 | 4 | 1.9 | 4 | 6 | 4 | 4 |
| Example 9 | 5 | 2 | 5 | 6 | 5 | 4 |
| Example 10 | 6 | 2 | 6 | 6 | 6 | 4 |
| Example 11 | 7 | 2 | 6 | 6 | 6 | 4 |
| Example 12 | 8 | 2 | 6 | 6 | 6 | 4 |
| Example 13 | 9 | 1.9 | 7 | 6 | 7 | 4 |
| Example 14 | 1 | 1.9 | 2 | 6 | 2 | 4 |
| Example 15 | 1 | 1.9 | 3 | 6 | 3 | 4 |
| Example 16 | 1 | 1.9 | 4 | 6 | 4 | 4 |
| Example 17 | 1 | 1.9 | 1 | 6 | 1 | 4 |
| Example 18 | 1 | 1.9 | 1 | 6 | 1 | 4 |
| Example 19 | 1 | 1.9 | 1 | 6 | 1 | 4 |

TABLE 2

| | First Component (wt %) | | Second Component (wt %) | | | Ratio First Component/ Second |
|---|---|---|---|---|---|---|
| No. | Cr | Al | Si | Zr | Fe(wt %) | Component |
| 1 | 6 | | 3 | | 91 | 0.5 |
| 2 | 4 | | 5 | | 91 | 1.25 |
| 3 | 2 | | 7 | | 91 | 3.5 |
| 4 | 1.5 | | 8 | | 90.5 | 5.33 |
| 5 | 1 | | 10 | | 89 | 10 |
| 6 | | 4 | 5 | | 91 | 1.25 |
| 7 | | 2 | 7 | | 91 | 3.5 |
| 8 | | 1.5 | 8 | | 90.5 | 5.33 |
| 9 | 2 | | | 7 | 91 | 3.5 |

TABLE 3

| | Distance between Conductive Portions [μm] | Number of Particles [Count] | Direct Current Resistance [mΩ] | Q — | Dielectric Breakdown — |
|---|---|---|---|---|---|
| Comparative Example 1 | 24 | 4 | 88 | 24 | A |
| Example 1 | 16 | 4 | 69 | 26 | A |
| Example 2 | 12 | 3 | 60 | 30 | A |
| Example 3 | 7.2 | 3 | 55 | 32 | A |
| Example 4 | 7.5 | 7 | 63 | 29 | A |
| Example 5 | 4.0 | 3 | 61 | 30 | A |
| Example 6 | 7.2 | 3 | 55 | 33 | A |
| Example 7 | 7.3 | 3 | 55 | 35 | A |
| Example 8 | 7.4 | 3 | 56 | 36 | A |
| Example 9 | 7.8 | 4 | 59 | 29 | B |
| Example 10 | 7.3 | 3 | 55 | 33 | A |
| Example 11 | 7.4 | 3 | 55 | 35 | A |
| Example 12 | 7.4 | 3 | 56 | 36 | A |
| Example 13 | 7.2 | 3 | 55 | 35 | A |
| Example 14 | 7.0 | 3 | 54 | 32 | A |
| Example 15 | 6.9 | 3 | 54 | 34 | A |
| Example 16 | 6.9 | 3 | 55 | 35 | A |

TABLE 3-continued

| | Distance between Conductive Portions [μm] | Number of Particles [Count] | Direct Current Resistance [mΩ] | Q — | Dielectric Breakdown — |
|---|---|---|---|---|---|
| Example 17 | 13 | 7 | 60 | 30 | A |
| Example 18 | 17 | 9 | 66 | 29 | A |
| Example 19 | 19 | 10 | 70 | 28 | A |

As shown in Tables 1 to 3, the laminated inductors of Examples 1 to 19 having the first magnetic layers with a thickness of 19 μm or smaller had lower direct current resistances and higher quality factors than the laminated inductor of Comparative Example 1. This is presumably because the first magnetic layers had a smaller thickness while the second magnetic layers and the conductive patterned portions had a larger thickness, such that the resistance of the coil is lower and the quality factor is higher (a lower loss).

In the laminated inductors of Examples 1 to 19, the magnetic alloy particles constituting the first magnetic layers had an average particle diameter of 4 μm or smaller. Therefore, the specific surface area of the magnetic alloy particles is increased, and thus the insulation quality of the first magnetic layers is improved and a desired withstanding voltage characteristic is obtained.

If, as with Examples 1 to 5, the composition of the magnetic alloy particles are the same, a smaller thickness of the first magnetic layers, which allows a larger thickness of the conductive patterned portions, allows a lower direct current resistance and a higher quality factor (a lower loss). In particular, the magnetic alloy particles of Examples 6 to 8 containing 5 to 8 wt % Si and 1.5 to 4 wt % Cr produce a quality factor that is about 25% or more higher than that of Comparative Example 1. Moreover, if, as in Example 2, the magnetic alloy particles have an average particle diameter of 3.2 μm or smaller, the insulation quality can be ensured with only three magnetic alloy particles. Therefore, the thickness of the layers can be reduced as long as three or more particles are arranged therein. However, if, as in Example 4, the magnetic alloy particles have an average particle diameter of 1 μm, the direct current resistance is higher than that of Example 3 due to a low magnetic permeability caused by the particle diameter and a low filling ratio caused by an increased amount of binders used in fabrication. Thus, the magnetic alloy particles can have an average particle diameter of 2 to 3 μm to achieve a low direct current resistance.

Example 6, which contains a larger amount of Si than Example 3, produced a higher quality factor than Example 3. This also applies to the relationship between Example 7 and Example 3 and the relationship between Example 8 and Example 3. Similarly, Example 8, which contains a larger amount of Si than Example 7, produced a slightly higher quality factor than Example 7.

Example 9 produced substantially the same direct current resistance and quality factor as Example 4 but produced a lower dielectric voltage than other Examples. This is probably because Example 9 contains a smaller amount of Cr than other Examples, and thus was subjected to excess oxidation, such that a large amount of Fe oxide (magnetite) having a low resistance was produced. Additionally, the expansion caused by the excess oxidation enlarged the distance between the conductive patterned portions.

Examples 10, 11, and 12 confirmed that the magnetic alloy particles having different compositions produce the same direct current resistance and quality factor as in Examples 6, 7, and 8.

Similarly, Example 13 produced the same direct current resistance and quality factor as Example 7.

Examples 14, 15, and 16 produced lower direct current resistances than Examples 6, 7, and 8, respectively. This is probably because the magnetic alloy particles of the second and third magnetic layers contained a larger amount of Si than those of the first magnetic layers, and the magnetic alloy particles of the first magnetic layers that were the softer in each pair of Examples were deformed to reduce the thickness of the first magnetic layers and increase the filling ratio.

Examples 17, 18 produced lower direct current resistances than Examples 1. This is because the magnetic alloy particles of these Examples had a smaller average particle diameter than those of Example 1. By contrast, Example 19 produced the same direct current resistance as Example 1, which indicates absence of the effect of the magnetic alloy particles having a smaller average particle diameter. Thus, the number of the magnetic alloy particles arranged in the first magnetic layer in the thickness direction thereof may preferably be nine or smaller. Therefore, the number of the magnetic alloy particles arranged in the first magnetic layer in the thickness direction thereof may be 3 to 9 such that both the insulation quality and the direct current resistance are improved.

As described above, the laminated inductors of these Examples may have device characteristics including a low resistance and a high efficiency. In addition, since the size and thickness of the components can be reduced, these laminated inductors can be satisfactory used for power device applications.

Embodiments of the present invention are not limited to the above descriptions and are susceptible to various modifications.

For example, the external electrodes 14, 15 of the above embodiments may be provided on the two end surfaces of the component body 11 opposed with each other in the lengthwise direction of the component body 11, but this is not limitative. It may also be possible that the external electrodes 14, 15 be provided on the two end surfaces of the component body 11 opposed with each other in the widthwise direction of the component body 11.

Additionally, the laminated inductor 10 of the above embodiments may include a plurality of first magnetic layers 121, but it may also be possible that the laminated inductor include a single first magnetic layer 121 (that is, the internal conductor include two conductive patterned portions).

What is claimed is:

1. A laminated inductor, comprising:

at least one first magnetic layer, the at least one first magnetic layer including three or more magnetic alloy particles arranged in the one axial direction and a first oxide film, the three or more magnetic alloy particles having an average particle diameter of 4 μm or smaller, the first oxide film binding the magnetic alloy particles together and containing a first component including one or both of Cr and Al;

an internal conductor including a plurality of conductive patterned portions, the plurality of conductive patterned portions being disposed so as to be opposed to each other in the one axial direction across the at least one first magnetic layer, the plurality of conductive patterned portions electrically connected to each other with the at least one first magnetic layer placed therebetween, each of the plurality of conductive patterned portions constituting a part of a coil wound around the one axial direction;

a plurality of second magnetic layers composed of magnetic alloy particles, the plurality of second magnetic layers being disposed around the plurality of conductive patterned portions so as to be opposed to each other in the one axial direction across the at least one first magnetic layer;

a plurality of third magnetic layers composed of magnetic alloy particles, the plurality of third magnetic layers being disposed so as to be opposed to each other in the one axial direction across the at least one first magnetic layer, the plurality of second magnetic layers, and the internal conductor; and a pair of external electrodes electrically connected to the internal conductor.

2. The laminated inductor of claim 1, wherein the at least one first magnetic layer further includes a second oxide film disposed between the magnetic alloy particles and the first oxide film, and the second oxide film contains a second component including one or both of Si and Zr.

3. The laminated inductor of claim 2, wherein the magnetic alloy particles constituting the at least one first magnetic layer, the plurality of second magnetic layers, and the plurality of third magnetic layers contain the first component, the second component, and Fe, with a ratio of the second component to the first component being larger than 1.

4. The laminated inductor of claim 2, wherein the magnetic alloy particles constituting the plurality of second magnetic layers and the plurality of third magnetic layers contain 1.5 to 4 wt % of the first component and 5 to 8 wt % of the second component.

5. The laminated inductor of claim 1, wherein the at least one first magnetic layer, the plurality of second magnetic layers, and the plurality of third magnetic layers include a resin material between the respective magnetic alloy particles.

6. The laminated inductor of claim 1, wherein the at least one first magnetic layer, the plurality of second magnetic layers, and the plurality of third magnetic layers include a phosphorus element between the respective magnetic alloy particles.

* * * * *